US007878608B2

(12) United States Patent
Shimizu et al.

(10) Patent No.: US 7,878,608 B2
(45) Date of Patent: Feb. 1, 2011

(54) LIQUID DISCHARGE APPARATUS AND MAINTENANCE METHOD FOR LIQUID DISCHARGE APPARATUS

(75) Inventors: Yoichiro Shimizu, Kasugai (JP); Takahiro Yamada, Toyoake (JP); Naoya Okazaki, Gifu (JP); Masaru Someya, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 536 days.

(21) Appl. No.: 12/005,755

(22) Filed: Dec. 28, 2007

(65) Prior Publication Data

US 2008/0158271 A1 Jul. 3, 2008

(30) Foreign Application Priority Data

Dec. 29, 2006 (JP) ..... 2006-356794

(51) Int. Cl.
*B41J 29/38* (2006.01)

(52) U.S. Cl. ..... 347/5; 347/9; 347/35

(58) Field of Classification Search ..... 347/5, 347/7, 19, 23–35, 9
See application file for complete search history.

(56) References Cited

U.S. PATENT DOCUMENTS 6,837,560 B2 1/2005 Ebisawa

FOREIGN PATENT DOCUMENTS

JP 2001212982 8/2001
JP 2004058663 2/2004

*Primary Examiner*—Lam S Nguyen
(74) *Attorney, Agent, or Firm*—Frommer Lawrence & Haug LLP

(57) ABSTRACT

A liquid discharge apparatus includes a discharge head which discharges a liquid from a discharge port onto a recording medium to form an image, a sub tank which is movable together with the discharge head and which stores the liquid to be supplied to the discharge head, a liquid supplement section which supplements the sub tank with the liquid, a purge section which performs a purge operation in which the liquid in the sub tank is pressurized to be fed to the discharge head, and the liquid in the discharge head is forcibly discharged from the discharge ports, a judging mechanism which judges whether or not an amount of the liquid in the sub tank is not more than a predetermined amount $V_1$, and a controller which controls the liquid supplement section and the purge section.

17 Claims, 11 Drawing Sheets

INK SUPPLEMENT PROCESS

LIQUID DISCHARGE APPARATUS AND MAINTENANCE METHOD FOR LIQUID DISCHARGE APPARATUS

CROSS REFERENCE TO RELATED APPLICATION

The present application claims priority from Japanese Patent Application No. 2006-356794, filed on Dec. 29, 2006, the disclosure of which is incorporated herein by reference in its entirety.

BACKGROUND OF THE INVENTION

1. Field of the Invention

The present invention relates to a liquid discharge apparatus for forming an image on a recording medium by discharging a liquid. In particular, the present invention relates to a liquid discharge apparatus of the type in which the maintenance is performed in accordance with the purge operation. In the purge operation, the liquid in a sub tank is pressurized to be fed to a discharge head, and the liquid in the discharge head is forcibly discharged from the discharge head.

2. Description of the Related Art

A recording apparatus based on the ink-jet system is known as an example of the liquid discharge apparatus. The recording apparatus forms an image on a recording medium such as the recording paper by discharging the ink from the recording head. The discharge liquid such as the ink is viscous. Therefore, it is necessary to perform the maintenance for the recording head every time when a predetermined period of time has elapsed or when the instruction is made by a user. Examples of the maintenance are disclosed in Japanese Patent Application Laid-open No. 2001-212982 and U.S. Pat. No. 6,837,560 (corresponding to Japanese Patent Application Laid-open No. 2004-58663).

That is, Japanese Patent Application Laid-open No. 2001-212982 discloses a recording apparatus based on the so-called tube system in which an ink tank and a recording head are communicated with each other by a tube, and the ink is supplied from the ink tank to the recording head via the tube. In the case of this recording apparatus, a sensor is provided to detect the residual amount or residual quantity of the ink contained in the ink tank. The purge operation is executed by supplying the ink at a pressure corresponding to the residual amount of the ink detected by the sensor.

On the other hand, U.S. Pat. No. 6,837,560 discloses a recording apparatus based on the so-called station system (also referred to as "on-demand system") in which the ink is supplied from a main tank to a sub tank connected to a recording head. In the case of this recording apparatus, on supplementing the sub tank with the ink from the main tank when an image recording is performed, a maintenance for the interior of the recording head is performed by covering a discharge port of the recording head with a cap and sucking or pressurizing the ink in the recording head.

In the case of the maintenance for the liquid discharge apparatus based on the station system, unlike the example described above, the purge operation is sometimes performed such that the interior of the sub tank is pressurized to forcibly supply the liquid toward the discharge head thereby the liquid is discharged from the discharge holes of the discharge head. If the maintenance is performed in accordance with the purge operation as described above, when the pressurization is performed, the internal pressure of the sub tank is changed depending on the residual amount of the ink contained in the sub tank.

For example, when the residual amount of the ink is small (when the volume of the sub tank not occupied by the ink is large), there is a possibility that the internal pressure of the sub tank required for the purge operation cannot be raised sufficiently, and it is impossible to perform any appropriate maintenance. On the other hand, if a large-sized pump is installed in order to raise the internal pressure, then the liquid discharge apparatus is large-sized, and the cost becomes expensive, which is not preferred.

SUMMARY OF THE INVENTION

In view of the above, an object of the present invention is to provide a liquid discharge apparatus based on the station system which is constructed so that the appropriate maintenance can be realized by the purge operation in which the internal pressure of a sub tank is sufficiently raised while avoiding the large size of a pump.

According to a first aspect of the present invention, there is provided A liquid discharge apparatus, including: a discharge head which has a discharge port and discharges a liquid from the discharge port onto a recording medium to form an image thereon; a sub tank which is movable together with the discharge head and which stores the liquid to be supplied to the discharge head; a liquid supplement section which supplements the sub tank with the liquid; a purge section which performs a purge operation in which the liquid in the sub tank is pressurized to be fed to the discharge head, and the liquid in the discharge head is forcibly discharged from the discharge ports; a judging mechanism which judges whether or not an amount of the liquid in the sub tank is not more than a predetermined amount $V_1$; and a controller which controls the liquid supplement section and the purge section, wherein: when the purge operation is executed by the purge section, and when the judging mechanism judges that the amount of the liquid in the sub tank is not more than the predetermined amount $V_1$, the controller controls, before the execution of the purge operation, the liquid supplement section to supplement the sub tank with the liquid until the amount of the liquid contained in the sub tank exceeds the predetermined amount $V_1$.

According to the first aspect of the present invention, the sub tank can be supplemented with the liquid so that the liquid in the sub tank is successfully larger than the predetermined amount $V_1$ before the execution of the purge operation for pressurizing the interior of the sub tank in the liquid discharge apparatus based on the station system. Therefore, when the purge operation is executed, the internal pressure of the sub tank can be sufficiently increased without using any large-sized pump. It is possible to realize the purge operation which is suitable for the execution of the maintenance.

In the liquid discharge apparatus of the present invention, the purge section may include a charge tank which accumulates compressed air to be introduced into the sub tank, and an unoccupied volume $V_S$ of the sub tank, which is a volume of the sub tank, not occupied by the liquid after the sub tank is supplemented with the liquid from the liquid supplement section, may satisfy the following expression:

$$V_S \leqq \{(P_C - P_{S0})/(P_{S0} - P_0)\} \cdot V_C \quad (1)$$

wherein $P_C$ represents a charge pressure of gas in the charge tank, $P_{S0}$ represents a minimum pressure required to purge the sub tank, $P_0$ represents atmospheric pressure, and $V_C$ represents a volume of the charge tank. In this case, even when the minimum pressure $P_{S0}$, which is required for the purge operation, is applied to the interior of the sub tank, it is possible to realize the appropriate maintenance. The minimum pressure $P_{S0}$ is exemplified by the pressure which makes it possible to discharge any bubble existing at an intermediate position between the sub tank and the discharge port of the discharge head by way of example.

In the liquid discharge apparatus of the present invention, the predetermined amount $V_1$ and the unoccupied volume $V_S$ may satisfy the following expression:

$$V_1 = V_2 - V_S$$

wherein $V_2$ represents an entire volume of the sub tank.

In the liquid discharge apparatus of the present invention, the unoccupied volume $V_S$ of the sub tank, after the sub tank is supplemented with the liquid, may be a predetermined value greater than zero. In this case, it is unnecessary to perform the liquid supplement until the sub tank is fully filled. It is possible to reduce the amount of the supplement liquid within the range in which the expression (1) is satisfied. As a result, the period of time, which ranges from the start of the liquid supplement to the completion of the purge operation, can be shortened.

In the liquid discharge apparatus of the present invention, the controller may control the liquid supplement section so that a liquid-supplement velocity, which is adopted when the sub tank is supplemented with the liquid before the purge operation is executed, is greater than another liquid-supplement velocity which is adopted when the sub tank is supplemented with the liquid to form the image on the recording medium. In this case, it is possible to complete the maintenance by the purge operation earlier.

In the liquid discharge apparatus of the present invention, the liquid-supplement velocity, which is adopted when the sub tank is supplemented with the liquid to form the image on the recording medium, may be a velocity at which a meniscus formed at the discharge port of the discharge head is not destroyed, and the another liquid-supplement velocity, which is adopted when the sub tank is supplemented with the liquid before the purge operation, may be a velocity at which the meniscus is destroyed. In this case, the meniscus, which is formed at the discharge port, is not destroyed upon the liquid supplement when the image is formed on the recording medium. It is possible to satisfactorily maintain the discharge characteristic of the liquid. On the other hand, when the liquid supplement is performed before the purge operation, the liquid supplement can be performed at the velocity which is faster than the velocity adopted when the liquid supplement is performed to form the image on the recording medium. Therefore, the maintenance by the purge operation can be completed earlier.

In the liquid discharge apparatus of the present invention, the controller may control the liquid supplement section to supplement the sub tank with the liquid again after the purge operation has been performed by the purge section. In this case, although the liquid contained in the sub tank is reduced by the execution of the purge operation, the sub tank is supplemented with the liquid again. Therefore, it is possible to avoid the reduction of the processing amount (throughput) concerning the image formation after the maintenance.

In the liquid discharge apparatus of the present invention, the liquid supplement section and the purge section may be arranged with a transport path for the recording medium intervening therebetween. In this arrangement, it is possible to realize the liquid discharge apparatus having a layout with an appropriate weight balance.

In the liquid discharge apparatus of the present invention, the liquid supplement section and the purge section may be arranged adjacently in one area of two areas comparted by a transport path for the recording medium. In this arrangement, the positions of the discharge head and the sub tank, at which the purge operation is executed, are close to the positions of the discharge head and the sub tank at which the liquid supplement is executed prior to the purge operation. Therefore, it is possible to shorten the period of time required for the movement of the discharge head and the sub tank between the both positions until the purge operation is started after the completion of the liquid supplement. It is possible to shorten the overall period of time required for the maintenance.

In the liquid discharge apparatus of the present invention, the liquid supplement section may be arranged closer to the transport path than the purge section. In this arrangement, the liquid supplement section, which is also operated when the image is formed other than when the maintenance is performed and which is operated more frequently than the purge section, is arranged nearer to the transport path. The discharge head and the sub tank can be moved to the liquid supplement section in a short period of time. Therefore, it is possible to quicken the liquid supplement operation, and it is possible to improve the processing ability of the liquid discharge apparatus.

In the liquid discharge apparatus of the present invention, the liquid supplement section may have a main tank which stores the liquid to be supplemented to the sub tank, and the controller may control the liquid supplement section to communicate the main tank and the sub tank, and to recover the liquid, remaining in the sub tank to the main tank, and to perform a liquid supplement operation in which the sub tank is supplemented with the liquid from the main tank. In this case, even when any sensor for detecting the remaining amount of the liquid in the sub tank is not individually provided, the sub tank can be supplemented with a constant amount of the liquid. Therefore, it is possible to avoid any large size and any heavy weight of the sub tank, and it is possible to consequently avoid any large size and any heavy weight of the liquid discharge apparatus.

In the liquid discharge apparatus of the present invention, the liquid supplement section may have a pump which is capable of executing a sucking operation for recovering the liquid in the sub tank to the main tank, and a pressurizing operation for supplying the liquid in the main tank to the sub tank. In this arrangement, it is possible to execute the series of the liquid supplement operation by operating the pump.

In the liquid discharge apparatus of the present invention, when the purge operation is executed by the purge section, and only when the liquid is discharged from the discharge head after previous supplement for the sub tank with the liquid, the controller may control the liquid supplement section to execute the liquid supplement operation. In this arrangement, even when the purge operation is executed, it is enough that the liquid supplement is not particularly performed again, provided that the liquid is not discharged after the previous liquid supplement. Therefore, it is possible to shorten the required period of time by a period of time required for the liquid supplement in the maintenance.

According to a second aspect of the present invention, there is provided a maintenance method for a liquid discharge apparatus provided with a discharge head which has a discharge port and which discharges a liquid from the discharge port onto a recording medium to form an image thereon, a sub tank which is movable together with the discharge head and which stores the liquid to be supplied to the discharge head, a main tank which supplements the sub tank with the liquid, and a purge section which performs a purge operation in which the liquid in the sub tank is pressurized to be fed to the discharge head, and the liquid in the discharge head is forcibly discharged from the discharge ports, the maintenance method including: detecting a timing for maintenance; detecting a liquid-residual amount of the liquid remained in the sub tank; supplementing the liquid from the main tank to the sub tank until the liquid-residual amount of the liquid remaining in the sub tank is greater than a threshold value $V_1$ when the liquid-residual amount is not more than the predetermined threshold value $V_1$; and performing the purge operation by the purge section.

According to the second aspect of the present invention, if the residual amount of the ink contained in the sub tank is not more than the predetermined threshold value $V_1$ at the maintenance timing, the purge operation is performed after the ink supplement is performed until the residual amount of the ink contained in the sub tank is more than the threshold value $V_1$. Therefore, when the purge operation is performed, the internal pressure of the sub tank can be sufficiently raised without using any large-sized pump.

In the maintenance method of the present invention, the purge section may include a charge tank which accumulates compressed air to be introduced into the sub tank, and the liquid may be supplemented so that an unoccupied volume $V_S$, of the sub tank, which is not occupied by the liquid after the sub tank is supplemented with the liquid from the main tank, satisfies the following expression:

$$V_S \leqq \{(P_C - P_{S0})/(P_{S0} - P_0)\} \cdot V_C$$

wherein $P_C$ represents a charge pressure of gas in the charge tank, $P_{S0}$ represents a minimum pressure required to purge the sub tank, $P_0$ represents atmospheric pressure, and $V_C$ represents a volume of the charge tank. When the ink supplement is performed as described above, it is possible to realize the appropriate maintenance even when the minimum pressure $P_{S0}$ required for the purge is applied to the interior of the sub tank.

In the maintenance method of the present invention, the threshold value $V_1$ and the unoccupied volume $V_S$ may satisfy the following expression:

$$V_1 = V_2 - V_S$$

wherein $V_2$ represents a volume of the sub tank.

In the maintenance method of the present invention, when the liquid-residual amount in the sub tank is not more than the predetermined threshold value $V_1$, then the liquid in the sub tank may be recovered to the main tank, and the liquid may be supplemented thereafter from the main tank to the sub tank until the liquid-residual amount in the sub tank is greater than the threshold value $V_1$. According to this method, the vacant volume of the sub-ink chamber can be always made constant when the liquid supplement is performed from the main tank to the sub tank. Therefore, it is unnecessary to provide any sensor for the sub tank in order to detect the liquid amount.

In the maintenance method of the present invention, when the liquid-residual amount in the sub tank is more than the predetermined threshold value $V_1$, the purge operation may be performed by the purge section without supplementing the sub tank with the liquid. If the residual amount of the liquid in the sub tank is more than the predetermined threshold value $V_1$, the pressure required for the purge can be applied to the liquid contained in the sub tank. Therefore, it is unnecessary to supplement the sub tank with the liquid.

The maintenance method of the present invention may further include supplementing the liquid again from the main tank to the sub tank after the purge operation. In this procedure, the supplement is performed for the liquid contained in the sub tank having been reduced by the execution of the purge operation. Therefore, it is possible to avoid the reduction of the processing amount (throughput) concerning the image formation after the maintenance.

DESCRIPTION OF THE PREFERRED EMBODIMENTS

An explanation will be specifically made below with reference to the drawings about a liquid discharge apparatus according to an embodiment of the present invention.

Figure 1:
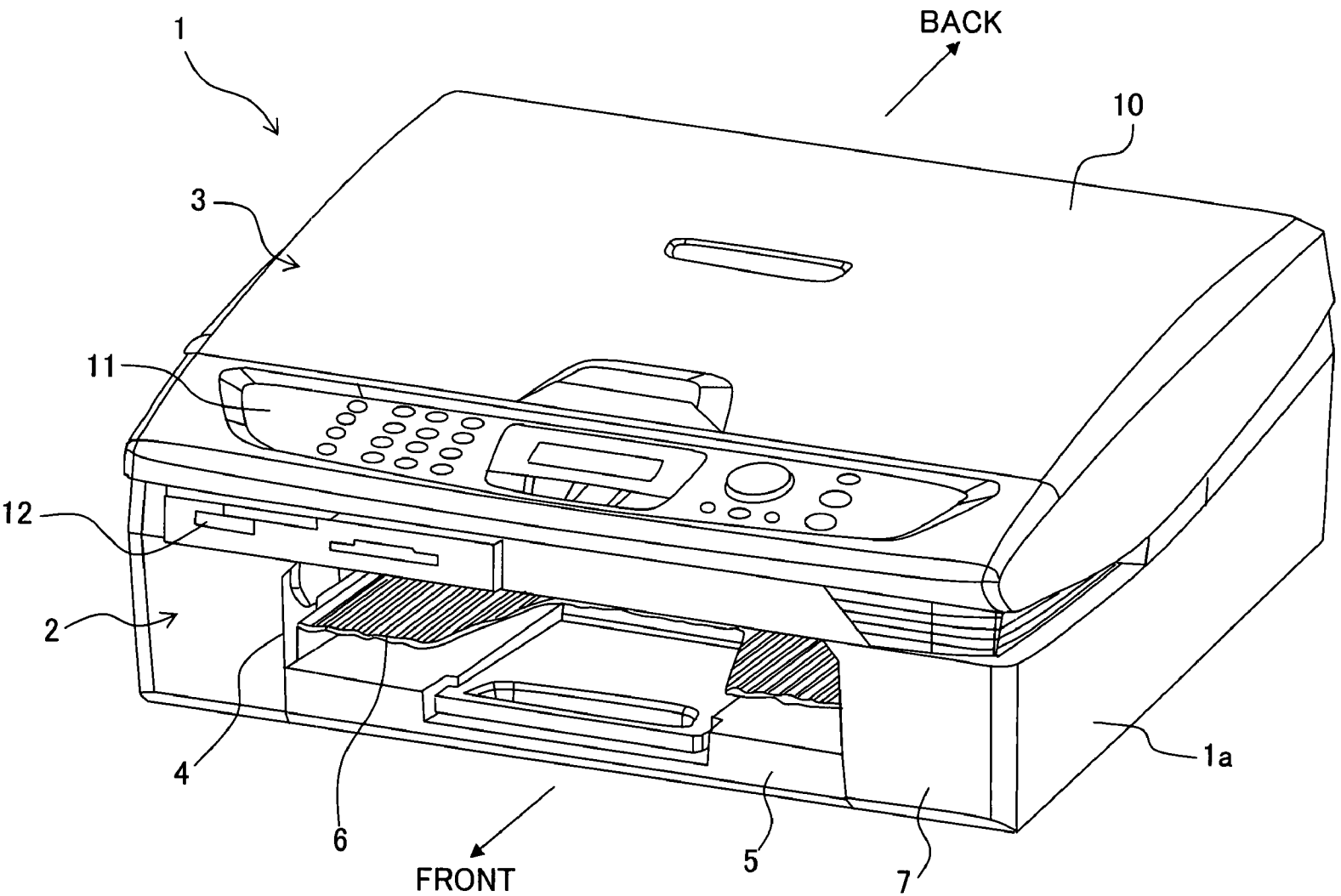
FIG. 1 shows a perspective view illustrating a structural appearance of a recording apparatus provided with a liquid discharge apparatus according to an embodiment of the present invention.

FIG. 1 shows a perspective view illustrating a structural appearance of a recording apparatus 1 provided with the liquid discharge apparatus according to the embodiment of the present invention. In this embodiment, the so-called multifunction machine is depicted as the recording apparatus 1. As shown in FIG. 1, the recording apparatus 1 is the multi function device. In the recording apparatus 1, a printer 2, which is the liquid discharge apparatus, is provided at a lower portion of a box-shaped casing 1*a* in order to record the image in accordance with the ink-jet system, and a scanner 3 is provided at an upper portion of the casing 1*a*. The recording apparatus 1 has the printer function, the scanner function, the copy function, and the facsimile function.

The recording apparatus 1 is connected to an external information device such as a personal computer so that the image is recorded on the recording paper as the recording medium based on the data transmitted from the computer or the like. When a digital camera or the like is connected to the recording apparatus 1, the photograph is recorded on the recording paper based on the data outputted from the digital camera or the like. Further, when various storage media such as memory cards are charged, the image can be recorded on the recording paper based on the data recorded on the storage medium as well.

As shown in FIG. 1, the recording apparatus 1 has an opening 4 which is disposed on the front surface (front side) of the printer (liquid discharge apparatus) 2 arranged at the lower portion. A paper feed tray 5 disposed on the lower side and a paper discharge tray 6 disposed on the upper side are provided in a two-stage form at the inside of the opening 4. A plurality of sheets of the recording paper can be accommodated in the paper feed tray 5. For example, a plurality of sheets of the recording paper, which have various sizes of not more than the A4 size, can be accommodated.

A door 7 is provided openably/closably at a lower-right portion on the front surface of the printer 2. A main tank-carrying section 8 (see FIG. 3) is provided at the inside of the door 7. Therefore, when the door 7 is opened, then the main tank-carrying section 8 is exposed on the front surface side, and main tanks (ink cartridges) 9 (see FIG. 3) can be attached/detached. Accommodating chambers, which correspond to the ink colors to be used, are provided for the main tank-carrying section 8. In the case of this printer 2, those used are color inks of five colors, i.e., cyan (C), magenta (M), yellow (Y), and photo black (PBk) as dye inks and black (Bk) as pigment ink. Therefore, the five accommodating chambers are comparted in the main tank-carrying section 8. The main tanks 9, which store the inks of the respective colors of cyan (C), magenta (M), yellow (Y), photo black (PBk), and black (Bk), are accommodated in the respective accommodating chambers.

The scanner 3, which is provided at the upper portion of the recording apparatus 1, is a so-called flat bed scanner. That is, as shown in FIG. 1, a manuscript cover 10, which is provided openably/closably as a top plate of the recording apparatus 1, is provided on the upper surface of the recording apparatus 1. For example, a platen glass on which the manuscript is placed and an image sensor which reads the image of the manuscript are arranged under the manuscript cover 10.

An operation panel 11, which is used to operate the printer 2 and the scanner 3, is provided at a front upper portion of the recording apparatus 1. The operation panel 11 is composed of various operation buttons and a liquid crystal display. The recording apparatus 1 is operated based on the instruction outputted from the operation panel 11 as a result of the operation of the operation panel 11 by a user. When the recording apparatus 1 is connected to the external computer, the recording apparatus 1 is also operated based on the instruction transmitted from the computer via a printer driver or a scanner driver.

A slot 12 is provided at a front upper-left portion of the recording apparatus 1. Various small-sized memory cards as storage media can be installed to the slot 12. When the predetermined operation is performed on the operation panel 11, the data, which is stored in the small-sized memory card installed to the slot 12, is read. The read data can be displayed on the liquid crystal display of the operation panel 11 as well. Any image, which is selected based on the display, can be recorded on the recording paper by the printer 2.

Figure 2:
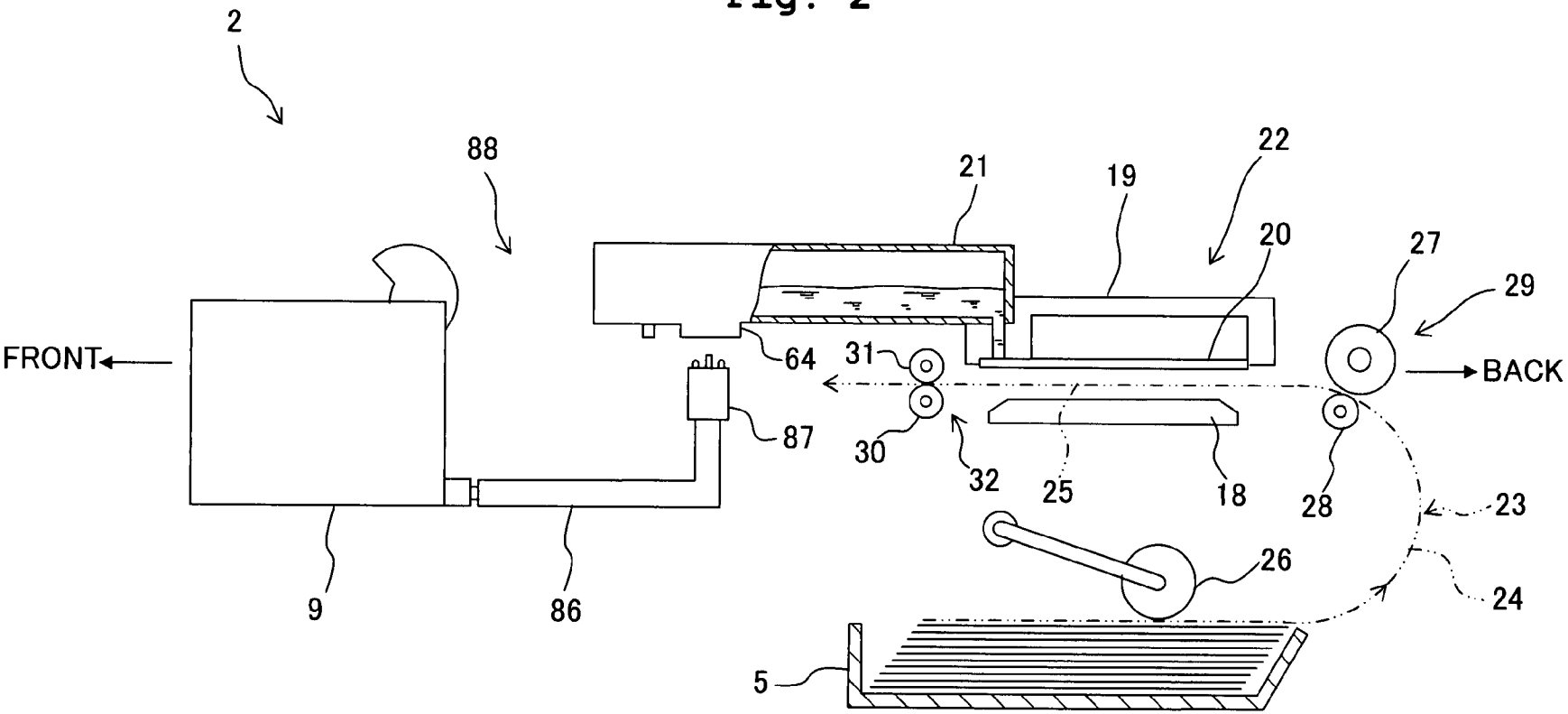
FIG. 2 shows a schematic sectional view illustrating an arrangement of a printer (liquid discharge apparatus) provided for the recording apparatus shown in FIG. 1.

FIG. 2 shows a schematic sectional view illustrating an arrangement of the printer 2. As shown in FIG. 2, the paper feed tray 5 is provided in the vicinity of the bottom of the recording apparatus 1. A platen 18 is provided over the paper feed tray 5. An image-recording unit 22, which includes, for example, a recording head (discharge head) 20 and a sub tank 21 carried on a carriage 19 as described later on, is provided over the platen 18. A recording paper transport path 23 is provided to extend from the deep side portion of the paper feed tray 5. The recording paper transport path 23 is composed of a curved path 24 which is directed upwardly from the deep side portion of the paper feed tray 5 and which is further curved toward the front surface side, and a straight path 25 which extends frontwardly from the terminal end of the curved path 24. The recording paper transport path 23 is constructed by an outer guide surface and an inner guide surface which are opposed to one another while providing a predetermined spacing distance at portions other than the portion at which the image-recording unit 22 is arranged.

A paper feed roller 26, which supplies the recording paper accommodated in the paper feed tray 5 to the recording paper transport path 23, is provided just over the paper feed tray 5. A pair of transport rollers 29, which are composed of a transport roller 27 and a pinch roller 28, are provided in the vicinity of the downstream portion of the curved path 24 in the recording paper transport path 23 so that the recording paper transport path 23 is interposed by the both rollers 27, 28 from the upper and lower positions. Further, a pair of paper discharge rollers 32, which are composed of a paper discharge roller 30 and a pinch roller 31, are provided in the vicinity of the downstream portion of the straight path 25 in the recording paper transport path 23 so that the recording paper transport path 23 is interposed by the both rollers 30, 31 from the upper and lower positions. The recording head 20 and the platen 18 described above are provided so that the straight path 25 is interposed from the upper and lower positions between the pair of transport rollers 29 and the pair of paper discharge rollers 32.

Therefore, the recording paper, which is accommodated in the paper feed tray 5, is supplied to the recording paper transport path 23 by the paper feed roller 26. Subsequently, the recording paper is transported from the curved path 24 to the straight path 25 on the recording paper transport path 23 by the pair of transport rollers 29. When the recording paper arrives at the straight path 25, the image is recorded thereon with the inks discharged from the recording head 20. When the recording is completed, then the recording paper is discharged from the straight path 25 by the pair of paper discharge rollers 32, and the recording paper is accommodated in the paper discharge tray 6 (see FIG. 1).

The recording apparatus 1 is capable of executing, for example, the ink supplement process for the sub tanks 21 and the maintenance process for the recording head 20 as described later on, in addition to recording the image on the recording paper. An ink supplement section (liquid supplement section) 88 is provided in front of the image-recording unit 22 as described later on.

Figure 3:
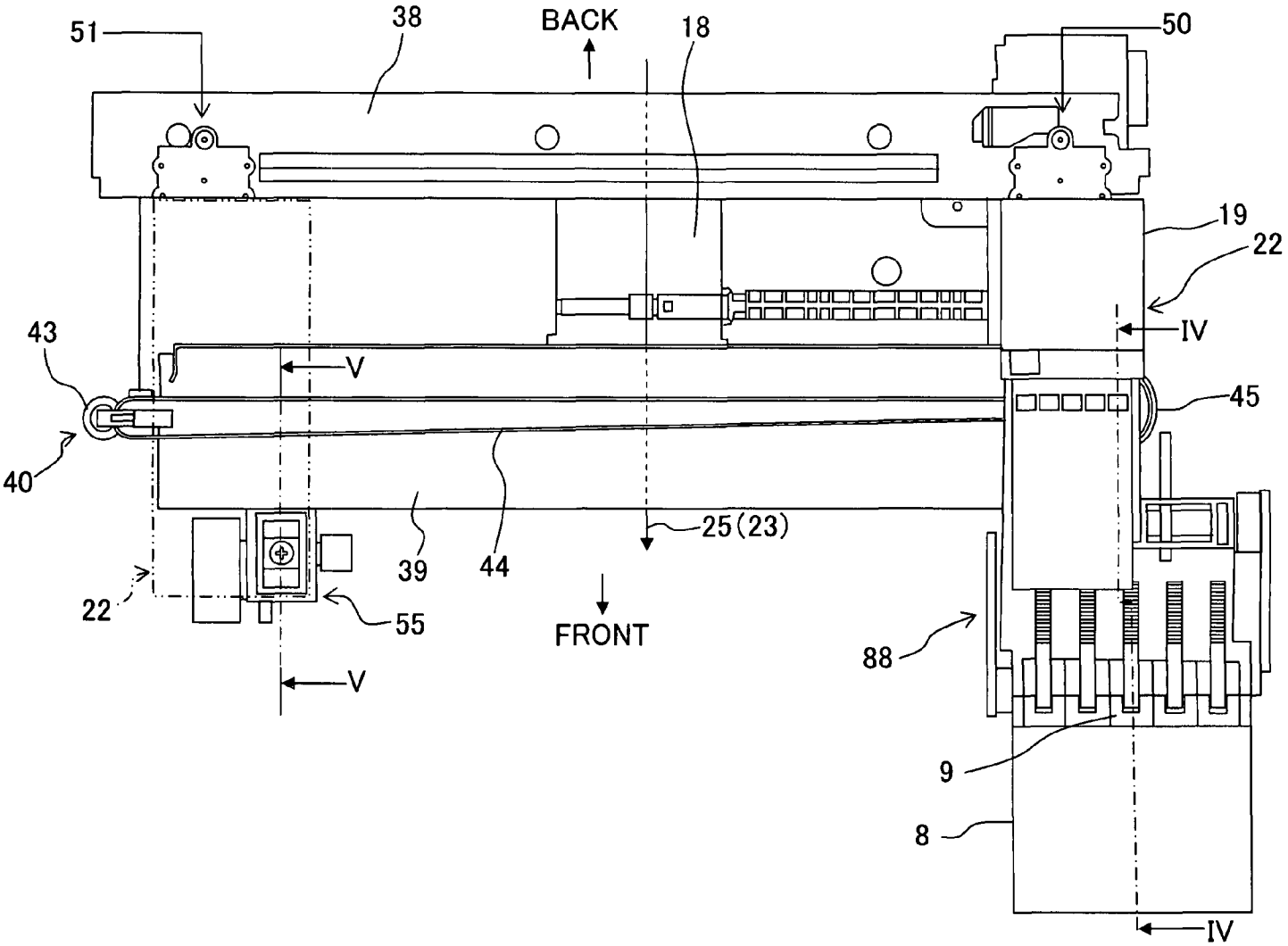
FIG. 3 shows a plan view illustrating main components of the printer shown in FIG. 2, wherein solid lines illustrate a state in which an image-recording unit is positioned at a predetermined position (ink supplement position) for performing the ink supplement, and two-dot chain lines illustrate a state in which the image-recording unit is positioned at a predetermined position (purge position) for performing the maintenance.

FIG. 3 shows a plan view illustrating main components of the printer 2. Solid lines illustrate a state in which the image-recording unit 22 is positioned at a predetermined position (ink supplement position 50) to perform the ink supplement, and two-dot chain lines illustrate a state in which the image-recording unit 22 is positioned at a predetermined position (purge position 51) for performing the maintenance. As shown in FIG. 3, a pair of guide rails 38, 39, each of which has a flat plate-shaped form that is long in the left-right direction (direction perpendicular to the transport direction of the recording paper), are arranged over or above the straight path 25 of the recording paper transport path 23. The guide rails 38, 39 are provided so that the guide rail 38 is positioned at the back of the guide rail 39 while being separated by a predetermined distance in the front-back direction (transport direction of the recording paper). The guide rails 38, 39 are provided in the casing 1*a* of the recording apparatus 1 (see FIG. 1), which constitute a part of the frame for supporting the respective constitutive components for constructing the printer 2. The carriage 19, which constitutes the image-recording unit 22, is supported by the guide rails 38, 39 so that the carriage 19 is slidable reciprocatingly in the extending direction (left-right direction) of the guide rails 38, 39.

As shown in FIG. 3, a belt-driving mechanism 40 is arranged on the upper surface of the guide rail 39. The belt-driving mechanism 40 includes an endless annular timing belt 44 which has teeth provided on the inner side and which tensionally spans a driving pulley (not shown) and a driven pulley 43 which are provided in the vicinity of the both ends in the widthwise direction of the recording paper transport path 23 respectively. A carriage motor 45 is connected to the shaft of the driving pulley 42. The driving pulley is rotated by inputting the driving force from the carriage motor 45. The timing belt 44 receives the rotation to perform the rounding motion between the driving pulley and the driven pulley 43.

The carriage 19 is secured to the timing belt 44 at the bottom thereof. Therefore, the carriage 19 makes the reciprocating motion in the left and right directions on the guide rails 38, 39 in accordance with the rounding motion of the timing belt 44. The recording head 20 and the sub tanks 21 are carried on the carriage 19 (see FIG. 2). Therefore, the recording head 20 reciprocates in the main scanning direction which is the left-right direction in accordance with the movement of the carriage 19.

As shown in FIG. 3, the position, which is disposed in the vicinity of the left ends of the guide rails 38, 39 as viewed in a plan view, is the ink supplement position 50. The main tanks 9 are arranged at the ink supplement position 50 in a state of being installed to the main tank-carrying section 8. When the carriage 19, which is movable along the guide rails 38, 39, is positioned at the ink supplement position 50 (state shown in FIG. 3), the ink supplement process is executed to perform the ink supplement from the main tanks 9 to the sub tanks 21 as described later on. The position, which is disposed in the vicinity of the right ends of the guide rails 38, 39 as viewed in a plan view, i.e., on the side opposite to the ink supplement position 50 with the recording paper transport path 23 intervening therebetween, is the purge position 51. A maintenance mechanism (purge section) 55 is arranged at the purge position 51. Therefore, when the carriage 19 is positioned at the purge position 51 (state shown by the two-dot chain lines in FIG. 3), then the purge process is performed for the recording head 20 by the maintenance mechanism 55 as described later on, and the maintenance is executed for the ink flow passage.

Figure 4:
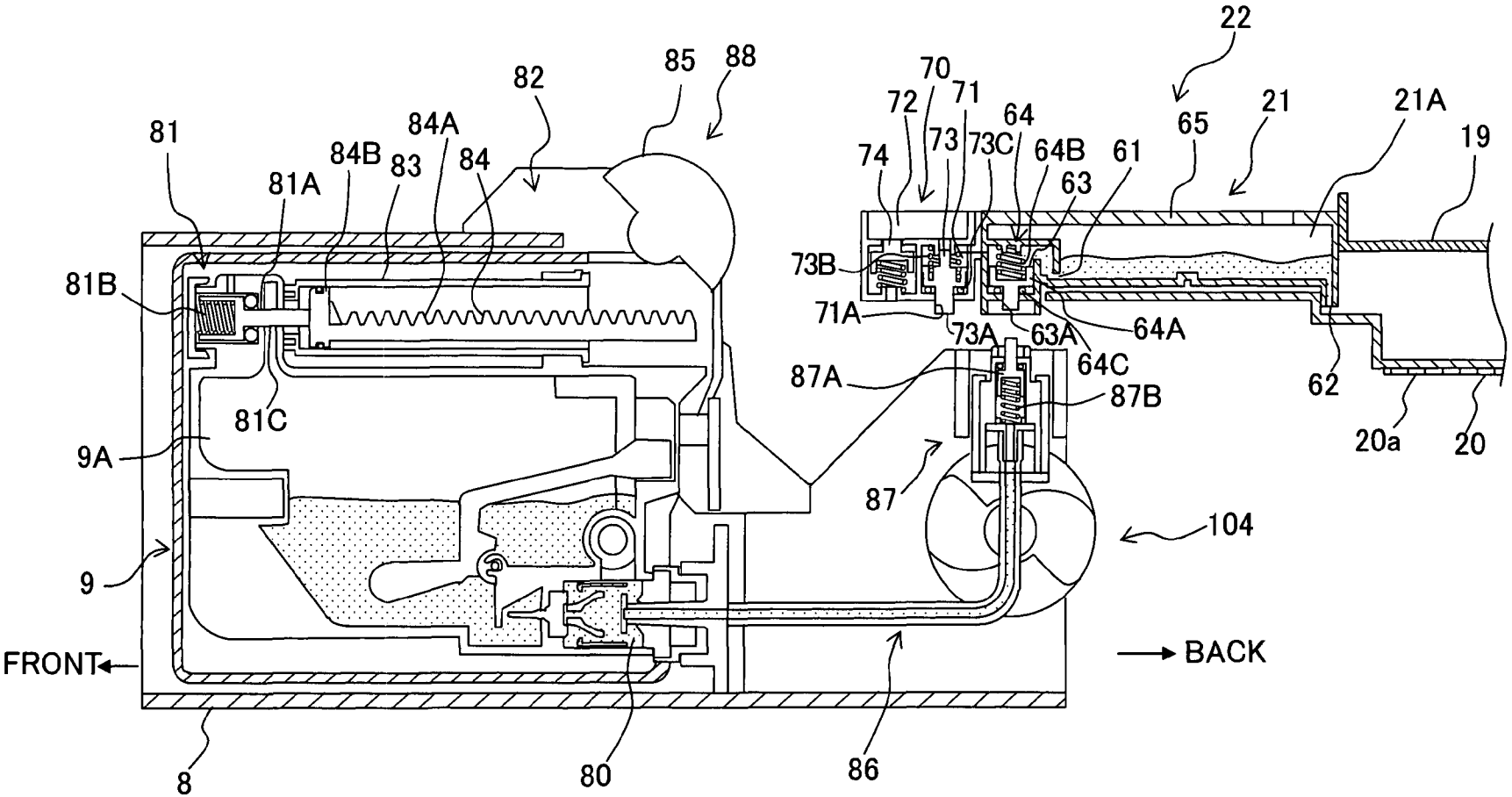
FIG. 4 shows a sectional view mainly illustrating the arrangement of the image-recording unit and a main tank, which depicts the arrangement as obtained by cutting a part of the printer shown in FIG. 3 along a line IV-IV.

Next, an explanation will be made about the arrangement of the image-recording unit 22 and the ink supplement section 88. FIG. 4 shows a sectional view mainly illustrating the arrangement of the image-recording unit 22 and the ink supplement section 88, which depicts the arrangement as obtained by cutting a part of the printer 2 shown in FIG. 3 along a line IV-IV.

As shown in FIG. 4, the image-recording unit 22 is provided with, for example, the recording head 20 and the sub tanks 21 which are carried on the carriage 19 having the rectangular casing form. The recording head 20 is constructed by stacking a plurality of plates (not shown), which has the ink flow passages (not shown) formed therein. Openings, which are disposed on the downstream side of the ink flow passages, form nozzle holes 20*a*.

The sub tank 21 has a box-shaped form in which the dimension in the left-right direction is smaller than the dimension in the front-back direction. Five of the sub tanks 21 are prepared in total one by one for each of the colors. As shown in FIG. 4, the sub tank 21 has a sub-ink chamber 21A having a predetermined volume, which has a first communication port 61 provided at a front side portion of the inner bottom, and a second communication port 62 provided at a back side portion of the inner bottom. The sub tank 21 is communicated with the upstream side opening of the ink flow passage possessed by the recording head 20 via the second communication port 62. The ink contained in the sub-ink chamber 21A is supplied to the recording head 20.

A refill port valve 64, which communicates the sub-ink chamber 21A and the main ink chamber 9A of the main tank 9 during the supplement with the ink, is provided in front of the sub-ink chamber 21A. In particular, a refill chamber 63, which communicates with the sub-ink chamber 21A via the first communication port 61, is provided in front of the first communication port 61. A refill port 63A, which communicates with the outside, is formed at a lower portion of the refill chamber 63. The refill port valve 64 is accommodated in the refill chamber 63. The refill port valve 64 is provided with a valve plug 64A which is inserted into the refill port 63A and which is movable upwardly and downwardly, a coil spring 64B which urges the valve plug 64A in the direction to close the refill port 63A (in the downward direction as viewed in FIG. 4), and a seal member 64C. The refill port valve 64 closes the refill port 63A by the urging force of the coil spring 64B in a state in which no external force is exerted on the valve plug 64A. On the other hand, when the external force is applied to move the valve plug 64A upwardly (toward the inside of the refill chamber 63), the refill port 63A is opened to communicate the outside and the sub-ink chamber 21A.

Further, a pressure-adjusting section 70 is provided in front of the sub tank 21. The pressure-adjusting section 70 has a negative pressure-adjusting chamber 71 which communicates with the sub-ink chamber 21A via a labyrinth structure 65 formed on the upper surface of the upper wall of the sub tank 21, and a positive pressure-adjusting chamber 72 which is positioned over or above the negative pressure-adjusting chamber 71. Further, the pressure-adjusting section 70 has a negative pressure-adjusting valve 73 which communicates the outside and the sub-ink chamber 21A via the negative pressure-adjusting chamber 71 during the purge, and a positive pressure-adjusting valve 74 which communicates the outside and the sub-ink chamber 21A via the positive pressure-adjusting chamber 72 and the negative pressure-adjusting chamber 71. The negative pressure-adjusting valve 73 is constructed in the same manner as the refill port valve 64. The negative pressure-adjusting valve 73 is provided with a valve plug 73A which is inserted into a communication hole 71A for communicating the negative pressure-adjusting chamber 71 and the outside and which is movable upwardly and downwardly, a coil spring 73B which urges the valve plug 73A in the direction to close the communication hole 71A, and a seal member 73C. When no external force is exerted on the valve plug 73A, the negative pressure-adjusting valve 73 closes the communication hole 71A by the urging force of the coil spring 73B. On the other hand, when the external force is applied to move the valve plug 73A upwardly (toward the inside of the negative pressure-adjusting chamber 71), the communication hole 71A is opened to communicate the outside and the negative pressure-adjusting chamber 71.

On the other hand, the main tanks 9 constitute the ink supplement section 88. As shown in FIG. 3, the main tank 9 has a box-shaped form in which the dimension in the left-right direction is smaller than the dimension in the front-back direction. Five of the main tanks 9 are prepared in total one by one for each of the colors. As shown in FIG. 4, the main tank 9 has a main ink chamber 9A having a predetermined volume. An ink supply port 80, which communicates with the main ink chamber 9A, is provided in the vicinity of the bottom. A positive pressure-adjusting valve 81 and a pump 82 are provided at upper portions.

The positive pressure-adjusting valve 81 has a valve plug 81A, and a coil spring 81B which urges the valve plug 81A. The positive pressure-adjusting valve 81 maintains the internal pressure of the main ink chamber 9A to be not more than a predetermined positive pressure value. That is, the communication is cut off or blocked between the main ink chamber 9A and the outside when the internal pressure of the main ink chamber 9A is not more than the predetermined positive pressure value, while the main ink chamber 9A and the outside are communicated with each other when the internal pressure exceeds the predetermined positive pressure value. A push rod 81C, which has a long dimension and which is rod-shaped, is provided to extend backwardly toward the pump 82 from the end surface of the valve plug 81A possessed by the positive pressure-adjusting valve 81.

The pump 82 is provided to change the volume of the main ink chamber 9A in order to supplement the sub-ink chamber 21A with the ink and in order to recover the ink from the sub-ink chamber 21A as described later on. The pump 82 is provided with a cylinder 83, a piston 84 which has a long dimension, which is rod-shaped, and which is accommodated in the cylinder 83, and a pinion gear 85 which drives the piston 84. In particular, the piston 84, which constitutes the pump 82, is provided with a rack gear 84A which is formed at an upper portion thereof, and a piston crown 84B which is provided at the forward end.

The rack gear 84A is meshed with the pinion gear 85. The piston 84 reciprocates in the front-back direction in the cylinder 83 in accordance with the rotary driving of the pinion gear 85. During this process, the piston crown 84B reciprocates while making the sliding contact with the inner wall surface of the cylinder 83 in the air-tight manner. A hole having a small diameter is formed through the wall disposed on one side of the cylinder 83. The push rod 81C, which is possessed by the positive pressure-adjusting valve 81, penetrates through the hole to extend to the interior of the cylinder 83. Therefore, when the piston 84 is moved frontwardly, then the piston crown 84B pushes and moves the valve plug 81A frontwardly by the aid of the push rod 81C, and the positive pressure-adjusting valve 81 is opened.

A joint valve 87, which is jointed to the refill port valve 64 provided for the sub tank 21, is attached via a tube 86 arranged outside the main tank 9 to the ink supply port 80 provided in the vicinity of the bottom of the main tank 9. The joint valve 87 is provided with, for example, a valve plug 87A which is movable in the vertical direction, and a coil spring 87B which urges the valve plug 87A upwardly. The joint valve 87 is closed by the urging force of the coil spring 87B when no external force is exerted on the valve plug 87A. When the external force directed in the downward direction is exerted on the valve plug 87A, and the valve plug 87A is moved in the downward direction against the urging force of the coil spring 87B, then the main ink chamber 9A is communicated with the outside via the tube 86 and the joint valve 87.

The joint valve 87 as described above is moved upwardly and downwardly by means of a lifting mechanism 104. Therefore, when the joint valve 87 is moved upwardly by means of the lifting mechanism 104 in a state in which the image-recording unit 22 is positioned at the ink supplement position 50, then the valve plug 87A of the joint valve 87 and the valve plug 64A of the refill port valve 64 are mutually pushed and moved, and the both valves 64, 87 are opened. As a result, the main ink chamber 9A of the main tank 9 and the sub-ink chamber 21A of the sub tank 21 are communicated with each other via the valves 64, 87.

In this embodiment, the ink supplement section 88 is constructed, for example, by the main tank 9 provided with, for example, the main ink chamber 9A and the pump 82, the tube 86, the joint valve 87, the lifting mechanism 104, the pinion gear 85 meshed with the pump 82, and the pinion gear-driving circuit 105 (see FIG. 5) for driving the pinion gear 85 included in the arrangement described above.

Figure 5:
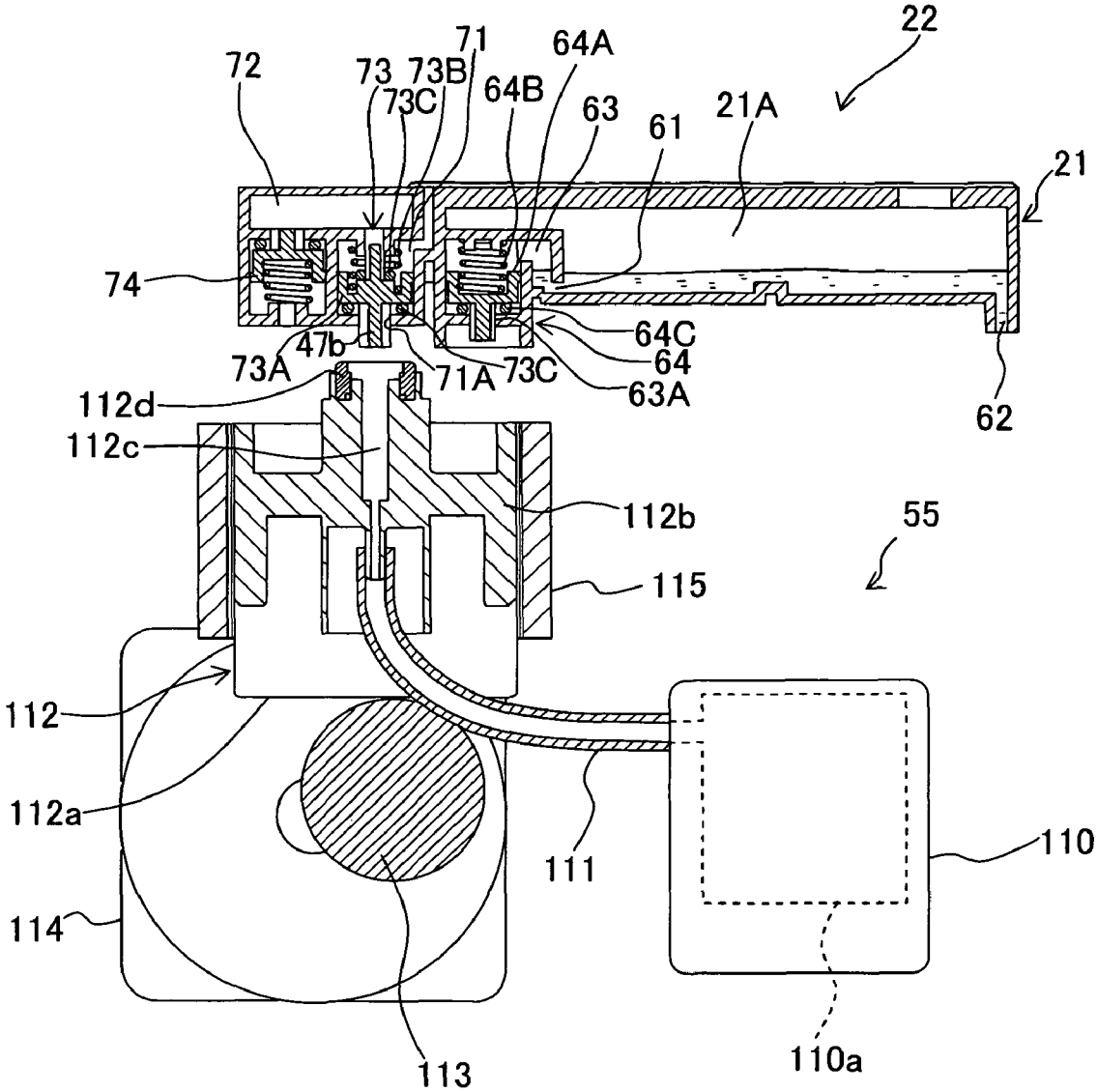
FIG. 5 shows a sectional view obtained by cutting, along a line V-V shown in FIG. 3, a part of the printer in the state in which the image-recording unit is positioned at the purge position, which mainly illustrates a cross-sectional arrangement of a maintenance mechanism (purge section) and the image-recording unit.

FIG. 5 shows a sectional view obtained by cutting, along a line V-V shown in FIG. 3, a part of the printer 2 in the state in which the image-recording unit 22 is positioned at the purge position 51, which mainly illustrates a cross-sectional arrangement of the maintenance mechanism 55 and the image-recording unit 22. As shown in FIG. 5, when the image-recording unit 22 is positioned at the purge position 51, the maintenance mechanism 55 is arranged under the negative pressure-adjusting valve 73.

The maintenance mechanism 55 is provided with a pressurizing pump 110 which has a charge tank 110*a* to supply the compressed air, a flexible tube 111 which derives the compressed air from the pressurizing pump 110, a gas-introducing member 112 which is connected to the forward end of the flexible tube 111, an eccentric cam 113 which makes abutment against the gas-introducing member 112 from the lower position, a motor 114 which rotates the eccentric cam 113, and a guide 115 which is stationarily placed to support the gas-introducing member 112 slidably in the vertical direction.

The gas-introducing member 112 is movable upwardly and downwardly. When the gas-introducing member 112 is positioned at the upper position, the gas-introducing member 112 pushes and moves the valve plug 73A of the negative pressure-adjusting valve 73 of the image-recording unit 22 to communicate the pressurizing pump 110 and the negative pressure-adjusting chamber 71 each other. The gas-introducing member 112 has an abutment section 112*a* which is provided with the lower surface making contact with the eccentric cam 113, and a communicating member 112*b* which is supported by the abutment section 112*a*. The forward end of the flexible tube 111 is connected to the communicating member 112*b*. Further, the communicating member 112*b* makes contact with the inner circumferential surface of the guide 115, and the communicating member 112*b* is movable upwardly and downwardly by being guided thereby. The communicating member 112*b* has an internal passage 112*c* communicated with the flexible tube 111. An annular seal member 112*d* is attached to the circumferential edge portion of the upper opening of the internal passage 112*c*.

Figure 6:
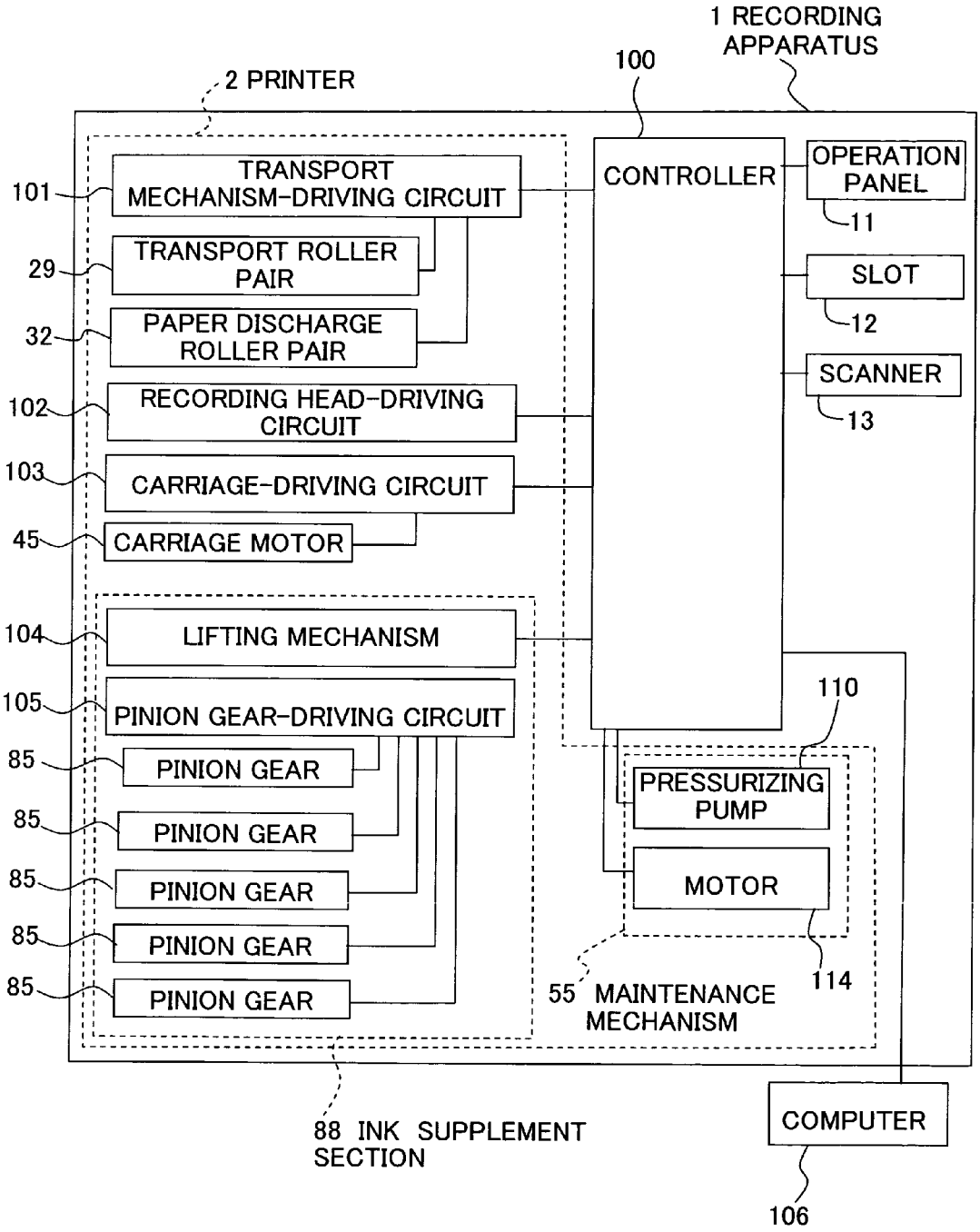
FIG. 6 shows a block diagram illustrating the function possessed by the recording apparatus shown in FIG. 1.

FIG. 6 shows a block diagram illustrating the function possessed by the recording apparatus 1 constructed as described above. As shown in FIG. 6, the recording apparatus 1 is provided with the controller 100. The controller 100 includes, for example, unillustrated CPU (Central Processing Unit), RAM (Random-Access Memory), ROM (Read-Only Memory), and an input/output interface. The scanner 3, the operation panel 11, and the slot 12 (see FIG. 1), which have been already explained, are connected to the controller 100. Those further connected to the controller 100 include the transport mechanism-driving circuit 101, the recording head-driving circuit 102, the carriage-driving circuit 103, the lifting mechanism 104, and the pinion gear-driving circuit 105. In particular, the lifting mechanism 104 and the pinion gear-driving circuit 105 constitute the ink supplement section 88. Further, the pressurizing pump 110 and the motor 114 are connected to the controller 100, which constitute the maintenance mechanism 55. The respective modules, which are connected to the controller 100, execute the operation as explained below based on the instruction signal supplied from the controller 100.

The transport mechanism-driving circuit 101 drives the unillustrated motor to rotate the transport roller pair 29 and the paper discharge roller pair 32 (see FIG. 2 as well) which are connected to the output shaft of the motor so that the recording paper is transported along the recording paper transport path 23. The recording head-driving circuit 102 controls the recording head 20 to discharge the ink toward the recording paper at the timing and in the ink amount determined based on the signal supplied from the controller 100. The controller 100 calculates the cumulative value of the discharge amount of each of the inks on the basis of the instruction signal as described above outputted to the recording head-driving circuit 102 so that the residual amount of the ink contained in the sub tank 21 is calculated.

The carriage-driving circuit 103 is connected to the carriage motor 45 (see FIG. 3). The carriage 19 is moved in the left-right direction by driving and rotating the carriage motor 45. The lifting mechanism 104 is driven based on the signal supplied from the controller 100 to move the joint valve 87 upwardly and downwardly. The pinion gear-driving circuit 105 drives the unillustrated motor to rotate the pinion gear 85 connected to the output shaft of the motor so that the pump 82 is driven to change the volume of the main ink chamber 9A.

The motor 114, which is possessed by the maintenance mechanism 55, is driven and rotated based on the signal supplied from the controller 100. Accordingly, the eccentric cam 113 is revolved, and the gas-introducing member 112 is moved upwardly and downwardly. The pressurizing pump 110, which is possessed by the maintenance mechanism 55, is driven based on the signal supplied from the controller 100 to derive the compressed air via the flexible tube 111 and the gas-introducing member 112.

Further, the controller 100 is connected to the personal computer (PC, hereinafter abbreviated as "computer") 106 as the external information device. The controller 100 outputs the instruction signal based on the signal supplied from the computer 106 or the operation panel 11.

Next, an explanation will be made about the operation of the recording apparatus 1 as described above.

At first, an explanation will be made about the ink supplement process for performing the ink supplement from the main tank 9 to the sub tank 21 when the image is recorded. When the residual amount of the ink in the sub-ink chamber 21A of the sub tank 21 is decreased to be not more than the predetermined threshold value, the recording apparatus 1 executes the ink supplement process by driving the ink supplement section 88 by the aid of the controller 100. The recording apparatus 1 according to this embodiment adopts the station supply system. When the process is executed, the series of ink supplement operation, which will be explained in detail below, is performed such that the residual ink is once recovered from the sub tank 21 to the main tank 9, and then the ink supplement is performed from the main tank 9 to the sub tank 21.

Figure 7:
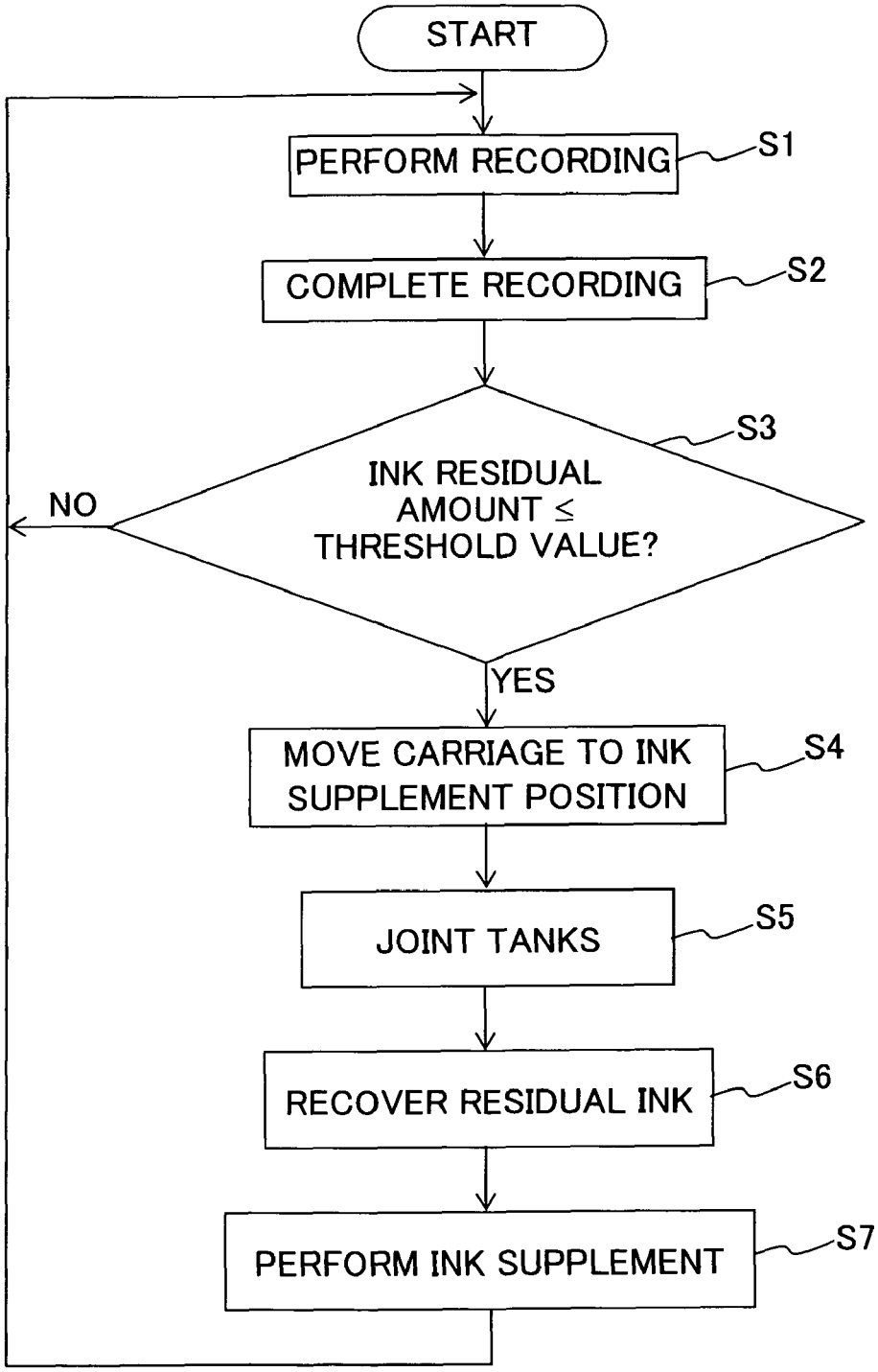
FIG. 7 shows a flow chart illustrating the operation of the recording apparatus in relation to the ink supplement process.
Figure 8A:
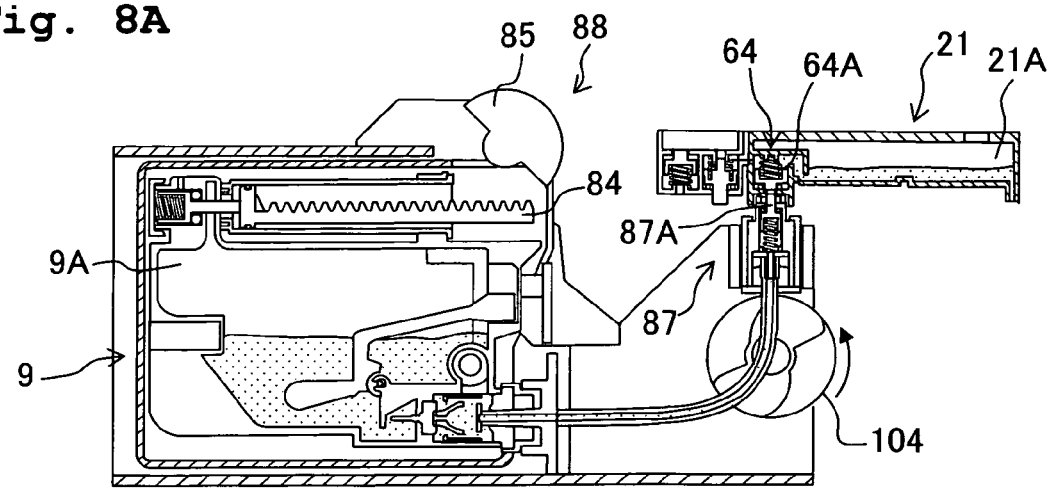
FIG. 8A schematically shows a state in which a cartridge and a sub tank are communicated with each other before the ink supplement, FIG. 8B schematically shows a state in which the ink is once recovered from the sub tank, and FIG. 8C schematically shows a state in which the sub tank is supplemented with the ink.
Figure 8B:
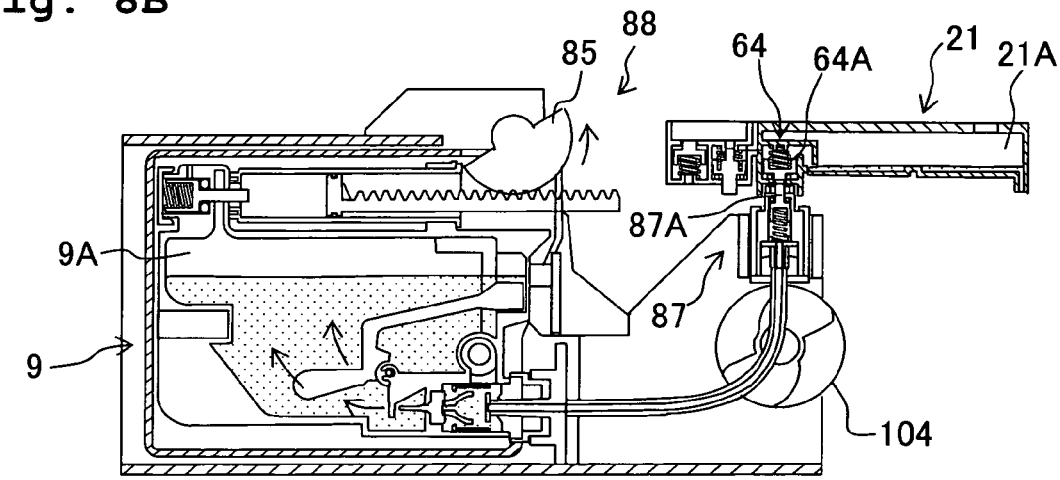
Figure 8C:
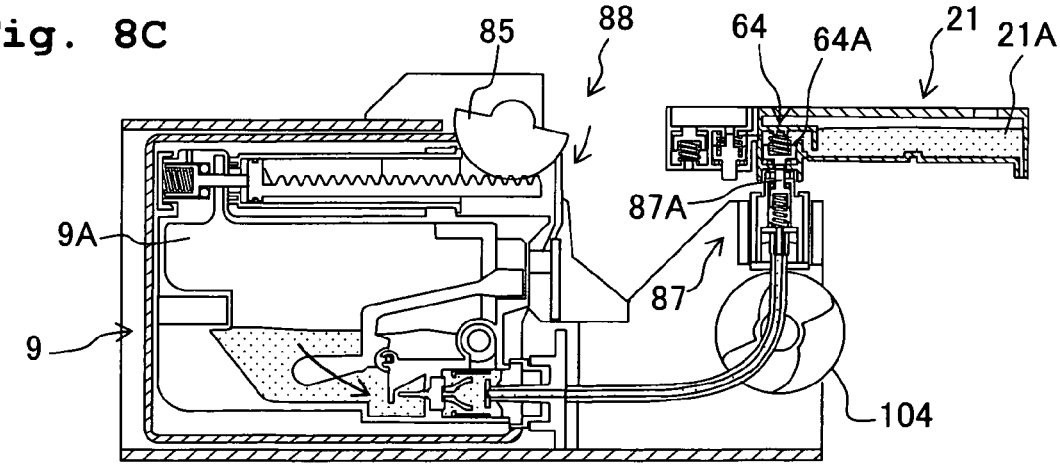

FIG. 7 shows a flow chart illustrating the operation of the recording apparatus 1 in relation to the ink supplement process. FIGS. 8A to 8C schematically show the state change of the image-recording unit 22 and the ink supplement section 88 during the ink supplement process. FIG. 8A shows a state in which the main tank 9 and the sub tank 21 are communicated with each other before the ink supplement, FIG. 8B shows a state in which the ink is once recovered from the sub tank 21, and FIG. 8C shows a state in which the sub tank 21 is supplemented with the ink. The state, in which the main tank 9 and the sub tank 21 are not communicated with each other before the ink supplement, is shown in FIG. 4 having been already referred to.

As shown in FIG. 7, the recording apparatus 1 performs the recording of the image on the recording paper (Step S1). At the point of time at which the recording is completed for one sheet of the paper (Step S2), CPU (judging mechanism) of the controller 100 judges whether or not the residual amount of the ink in the sub tank 21 is not more than the predetermined threshold value (Step S3). If the ink residual amount has a value which exceeds the threshold value (Step S3: NO), the routine returns to Step S1 to perform the recording on the next recording paper. If it is judged that the ink residual amount is not more than the threshold value (Step S3: YES), the carriage motor 45 (see FIG. 5) is driven to position the carriage 19 at the ink supplement position 50 (Step S4). In this situation, the main tank 9 and the sub tank 21 are in the positional relationship shown in FIG. 4. The predetermined threshold value referred to in Step S3 means the ink residual amount required for completing the recording on the next one sheet. The value may be previously stored, for example, in RAM of the controller 100 for each of the image types and the image quality modes.

Subsequently, the ink supplement section 88 is driven to joint the main tank 9 and the sub tank 21. That is, the lifting mechanism 104 is driven to move the joint valve 87 upwardly, and the sub-ink chamber 21A and the main ink chamber 9A are communicated with each other via the joint valve 87 and the refill port valve 64 as shown in FIG. 8A (Step S5).

When the both ink chambers 9A, 21A are communicated with each other, then the pinion gear 85 is rotated to move the piston 84 backwardly, and the negative pressure is provided in the main ink chamber 9A. Accordingly, as shown in FIG. 8B, the sucking operation is performed so that the residual ink in the sub-ink chamber 21A is once recovered to the main ink chamber 9A (Step S6). After the completion of the recovery process, the pinion gear 85 is reversely rotated to move the piston 84 frontwardly so that the positive pressure is provided in the main ink chamber 9A. Accordingly, as shown in FIG. 8C, the pressurizing operation is performed so that the ink supplement is performed from the main ink chamber 9A to the sub-ink chamber 21A (Step S7). When the supplement with the ink is completed by rotating the pinion gear 85 by a predetermined angle (number of revolutions), then the routine returns to Step S1 to restart the recording on the next recording paper.

In this way, in the ink supplement process of the recording apparatus 1 according to this embodiment, the vacant volume in the sub-ink chamber 21A is always substantially constant upon the supplement with the ink from the main ink chamber 9A, because the residual ink in the sub-ink chamber 21A is once recovered. Therefore, even when any sensor for detecting the ink amount is not provided for the sub tank 21, the ink supplement can be performed accurately to arrive at the maximum volume of the sub-ink chamber 21A.

Figure 9A:
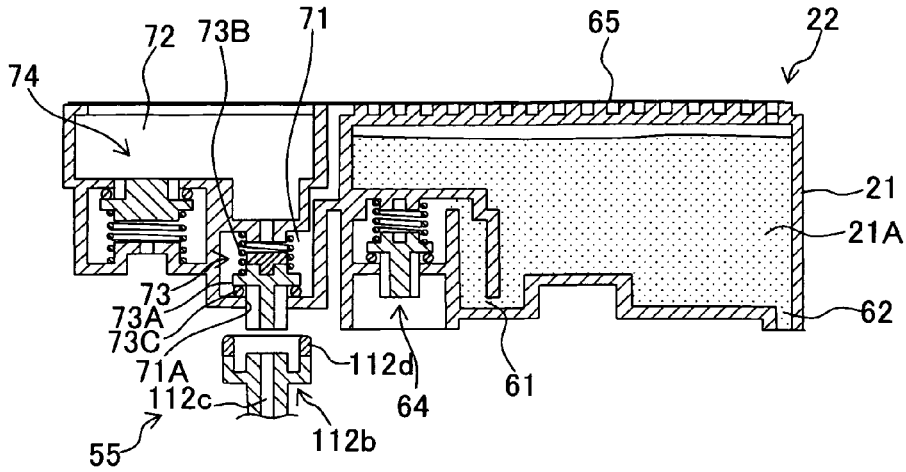
FIG. 9A schematically shows an arrangement in which a pressurizing pump and a negative pressure-adjusting chamber are in the non-communicated state, FIG. 9B schematically shows an arrangement in which the both are in the communicated state, and FIG. 9C schematically shows an arrangement in which the both are in the communicated state and the compressed air is introduced from the pressurizing pump.
Figure 9B:
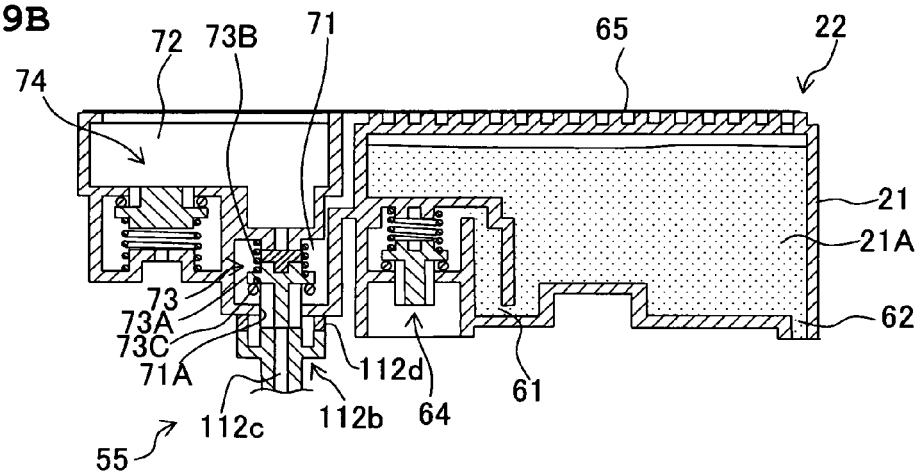
Figure 9C:
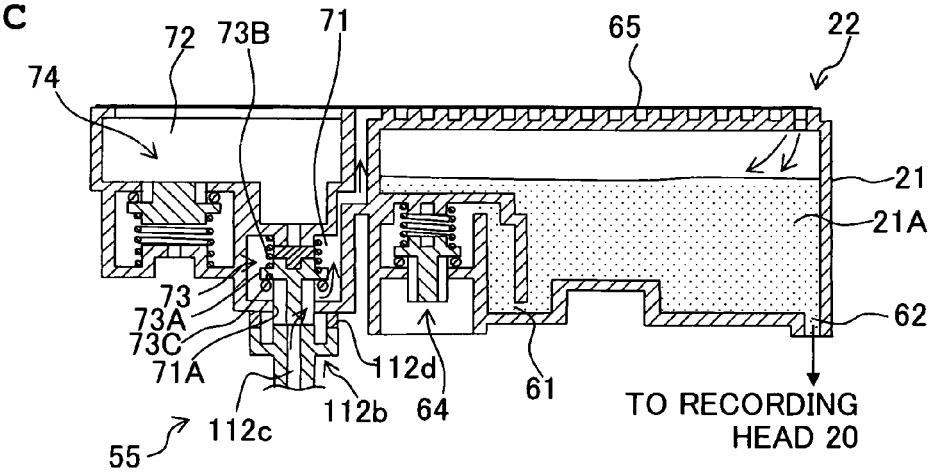

Next, an explanation will be made about the operation in relation to the purge process to be executed during the maintenance. FIGS. 9A to 9C schematically illustrate the operation in relation to the purge process. FIG. 9A shows an arrangement in which the pressurizing pump 110 and the negative pressure-adjusting chamber 71 are in the non-communicated state, FIG. 9B shows an arrangement in which the both are in the communicated state, and FIG. 9C shows an arrangement in which the both are in the communicated state and the compressed air is introduced from the pressurizing pump 110. As for the maintenance mechanism 55 shown in FIG. 9, only the seal member 112*d* and the communicating member 112*b* possessed by the gas-introducing member 112 are depicted for the purpose of convenience of illustration.

The maintenance mechanism 55 is operated as follows based on the signal supplied from the controller 100 in the state in which the image-recording unit 22 is positioned at the purge position 51 (see FIG. 3). That is, when the image-recording unit 22 is positioned at the purge position 51, the communication hole 71A, which is provided at the lower portion of the negative pressure-adjusting chamber 71, is arranged opposingly to the communicating member 112*b* of the gas-introducing member 112 (FIG. 9A). In this situation, when the motor 114 is driven to revolve the eccentric cam 113 about the output shaft of the motor 114, the gas-introducing member 112 is pushed upwardly by the eccentric cam 113. Accordingly, the communicating member 112*b* of the gas-introducing member 112 pushes and moves the valve plug 73A of the negative pressure-adjusting valve 73 upwardly against the urging force of the coil spring 73B, and the negative pressure-adjusting chamber 71 and the outside are communicated with each other via the communication hole 71A.

When the gas-introducing member 112 is pushed upwardly to the uppermost position, the communication is cut off or blocked between the negative pressure adjusting chamber 71 and the positive pressure-adjusting chamber 72 by the valve plug 73A of the negative pressure-adjusting valve 73. On the other hand, the annular seal member 112*d*, which is attached to the upper end of the communicating member 112*b* of the gas-introducing member 112, abuts against the bottom outer surface of the negative pressure-adjusting chamber 71 in the air-tight manner so that the communication hole 71A is positioned inwardly (FIG. 9B). In this situation, the internal passage 112*c* of the communicating member 112*b* and the negative pressure-adjusting chamber 71 are communicated with each other. As a result, the pressurizing pump 110, the flexible tube 111, the internal passage 112*c* of the communicating member 112*b*, the negative pressure-adjusting chamber 71, and the sub-ink chamber 21A of the sub tank 21 shown in FIG. 5 are mutually in the communicated state. The compressed air is introduced at a predetermined pressure from the pressurizing pump 110 into the sub-ink chamber 21A. The ink contained in the sub-ink chamber 21A is forcibly supplied to the recording head 20 (FIG. 9C). Accordingly, the ink, which has remained in the ink flow passage of the recording head 20, is forcibly discharged from the nozzle hole 20*a*, and the purge is completed for the recording head 20.

Figure 10:
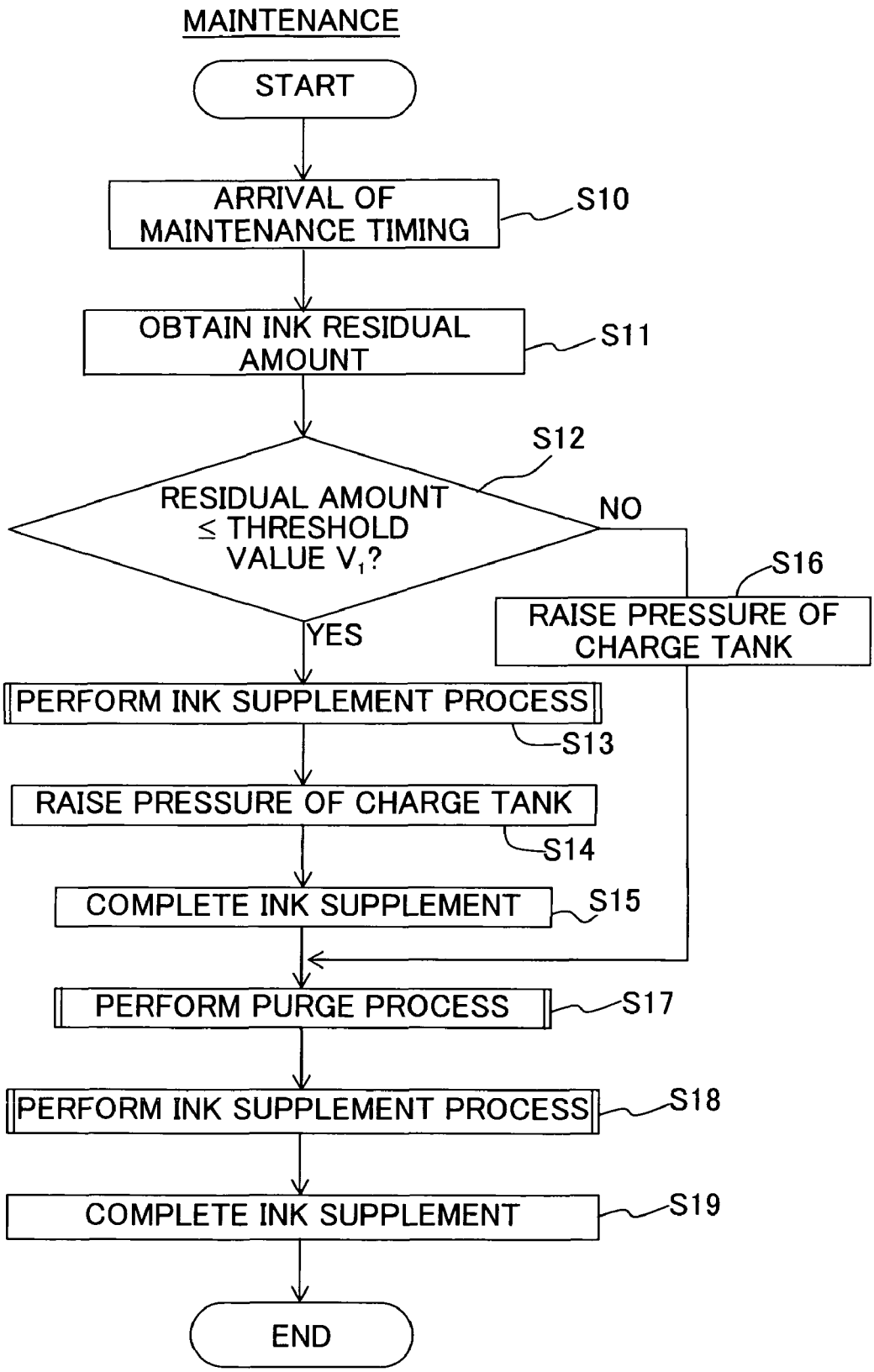
FIG. 10 shows a flow chart illustrating the maintenance process to be executed in the recording apparatus.

An explanation will be made about the maintenance process for the recording head 20 of the recording apparatus 1 as described above. FIG. 10 shows a flow chart illustrating the maintenance process. As shown in FIG. 10, when the maintenance process is performed, if the controller 100 judges that the timing is to execute the maintenance based on the elapsed time elapsed after the previous execution of the maintenance or the instruction from the user who has operated the operation panel 11 (Step S10), then the residual amount of the ink in the sub-ink chamber 21A is obtained (Step S11), and it is judged by CPU whether or not the value is not more than the predetermined threshold value $V_1$ (Step S12). In this case, the ink residual amount can be obtained by subtracting the ink discharge cumulative amount after the previous maintenance from the volume of the sub-ink chamber 21A. However, when a residual amount-detecting sensor is distinctly provided for the sub tank 21, the ink residual amount can be also obtained based on the output signal supplied from the sensor.

If it is judged in Step S12 that the ink residual amount is not more than the threshold value $V_1$ (Step S12: YES), an unoccupied volume $V_S$ in the sub-ink chamber 21A, which is the volume of the sub-ink chamber not occupied by the ink, is large in this state. Therefore, if the purge process is executed exactly in this state, there is a possibility that the minimum pressure $P_{S0}$ in the sub tank 21, which is required to execute the appropriate purge process, cannot be secured. Accordingly, the carriage motor 45 is driven so that the carriage 19 is positioned at the ink supplement position 50 to execute the ink supplement process having been already explained with reference to FIG. 7 (Step S13). During the ink supplement process, the pressurizing pump 110 is driven so that the internal pressure (charge pressure) of the charge tank 110*a* is raised to the predetermined pressure $P_C$ (Step S14).

If the ink amount in the sub tank 21 is an amount which exceeds the predetermined value $V_1$ to complete the ink supplement process (Step S15), then the carriage motor 45 is driven to position the carriage 19 at the purge position 51, and the purge process is executed as having been already explained with reference to FIG. 9 (Step S17).

On the other hand, if it is judged in Step S12 that the ink residual amount exceeds the threshold value $V_1$ (Step S12: NO), then the unoccupied volume $V_S$ in the sub-ink chamber 21A is small, and it is possible to secure the minimum pressure $P_{S0}$ in the sub tank 21 required to execute the appropriate purge process in this state. Accordingly, the ink supplement process (Step S13) is not performed. The pressurizing pump 110 is driven so that the internal pressure of the charge tank 110*a* is raised to the pressure $P_C$ (Step S16), and the purge process is executed (Step S17).

Further, in the case of the recording apparatus 1 according to this embodiment, when the purge process in Step S17 is completed, then the carriage 19 is positioned at the ink supplement position 50 in order to perform the supplement for the ink consumed in the concerning process, and the ink supplement process, which has been already explained with reference to FIG. 7, is executed (Step S18). Accordingly, it is possible to avoid the reduction of the processing amount (throughput) in relation to the image formation after the maintenance process. When the ink supplement process is completed (Step S19), the series of maintenance process comes to an end.

As explained above, in the maintenance process for the recording apparatus 1, if the ink residual amount in the sub tank 21 is not more than the predetermined value $V_1$, the ink supplement process is executed prior to the purge process. Accordingly, the unoccupied volume $V_S$ in the sub tank 21 can be decreased, and it is possible to secure the minimum pressure $P_{S0}$ in the sub tank 21 which makes it possible to execute the appropriate purge process when the purge is executed by introducing the compressed air from the pressurizing pump 110.

Therefore, the ink supplement amount in Step S13 can be determined to have such a value that the unoccupied volume $V_S$ in the sub tank 21 after the completion of the supplement process satisfies the following expression.

$$V_S \leqq \{(P_C - P_{S0})/(P_{S0} - P_0)\} \cdot V_C$$

In the expression described above, $P_C$ represents the charge pressure of the gas in the charge tank 110*a*, i.e., the internal pressure of the charge tank 110*a* upon the start of the gas introduction in accordance with the purge process. As explained above, $P_{S0}$ represents the minimum pressure in the sub tank 21 required to execute the appropriate purge process. In particular, $P_{S0}$ represents the internal pressure of the sub-ink chamber 21A when the gas introduction from the pressurizing pump 110 is completed and the internal pressures of the charge tank 110*a* and the sub-ink chamber 21A are in the equilibrium state. $P_O$ and $V_C$ mean the atmospheric pressure and the volume of the charge tank 110*a* respectively. The values thereof are previously stored, for example, in RAM of the controller 100.

The expression described above is calculated on the basis of the condition of $[P_S \geqq P_{S0}]$ in relation to the internal pressure $P_S$ of the sub-ink chamber 21A and the condition of $[P_C V_C + P_0 V_S = P_S(V_C + V_S)]$ focused on the relationship between the pressure and the volume before and after the purge provided that $P_S$ represents the internal pressure of the sub-ink chamber 21A when the internal pressures of the charge tank 11*a* and the sub-ink chamber 21A are in the equilibrium state.

It is enough that the unoccupied volume $V_S$ after the ink supplement in Step S13 is the value of not less than zero. That is, in the ink supplement process before the purge process, it is not necessarily indispensable that the ink is charged until arrival at an amount at which the sub tank 21 is fully filled with the ink. It is also allowable that the ink is supplemented as less as possible within the range in which the expression described above is satisfied. Accordingly, it is possible to shorten the time required for the ink supplement process. It is possible to complete the maintenance operation earlier.

The threshold value $V_1$, which relates to the ink residual amount to be used as the basis to judge whether or not the ink supplement is required beforehand in Step S12, can be determined as the ink residual amount which makes it possible to secure the pressure $P_{S0}$ in the sub tank 21 during the purge. The threshold value $V_1$ is defined as $[V_1 = V_2 - V_S]$ provided that $V_2$ represents the volume of the sub-ink chamber 21A of the sub tank 21.

In the explanation with reference to FIG. 10, it is judged whether or not the ink supplement is required by comparing the ink residual amount and the threshold value $V_1$ in Step S12. However, the judgment criterion is not limited thereto. For example, when the ink is not discharged from the recording head 20 at all after the sub tank 21 is previously supplemented with the ink, it can be judged that the ink supplement process before the purge process is unnecessary. Therefore, the following procedure may be explained with reference to the flow chart shown in FIG. 10. That is, if it is revealed that the ink is not discharged after the previous ink supplement to the sub tank 21 by allowing the controller 100 to retrieve the hysteresis in relation to the past ink discharge (recorded, for example, in RAM) after it is judged that the maintenance execution timing arrives (Step S10), then the operations of Steps S11, S12 may be skipped, and the routine may directly go to the pressure rise of the charge tank 110*a* (Step S16) and the purge process (Step S17).

In the case of the recording apparatus 1 according to this embodiment, the ink supplement speed $S_{P1}$ during the image formation is set to have the value which is different from that of the ink supplement speed $S_{P2}$ before the purge. Specifically, when the sub tank 21 is supplemented with the ink, the residual ink in the recording head 20 is slightly discharged from the nozzle holes 20*a* in some cases. When the ink supplement is performed during the image formation, i.e., when the ink in the sub tank 21 is insufficient in the middle of the continuous image formation on a plurality of sheets of the recording paper, and the ink supplement is performed in order to form the image on the next sheet of the recording paper, then it is necessary that the state of the ink existing in the nozzle holes 20*a* of the recording head 20 should be maintained as exactly as the state (meniscus) suitable for the image formation. On the other hand, in the case of the ink supplement before the purge, the new meniscus is formed by the purge process to be performed thereafter. Therefore, even when the meniscus is destroyed by the ink supplement, no inconvenience arises.

Therefore, in the recording apparatus 1, the speed is suppressed to the speed $S_{P1}$ of such an extent that the meniscus is not destroyed, in the case of the ink supplement during the image formation. The ink supplement is performed at the speed $S_{P2}$ which is greater than the speed $S_{P1}$, in the case of the ink supplement before the purge. Accordingly, the ink supplement process before the purge can be completed earlier. The unoccupied volume $V_S$ of the sub tank 21 after the ink supplement described above and the charge pressure $V_C$ of the charge tank 110*a* are determined on condition that the ink supplement speed $S_{P2}$ as described above can be achieved.

The foregoing explanation is illustrative of the arrangement (see FIG. 3) in which the ink supplement position 50 and the purge position 51 are separately arranged on the left and right sides of the recording paper transport path 23. However, in the case of the recording apparatus 1 according to the embodiment of the present invention in which the ink supplement process and the purge process are continuously executed during the maintenance, it is also possible to adopt the following different arrangement.

Figure 11:
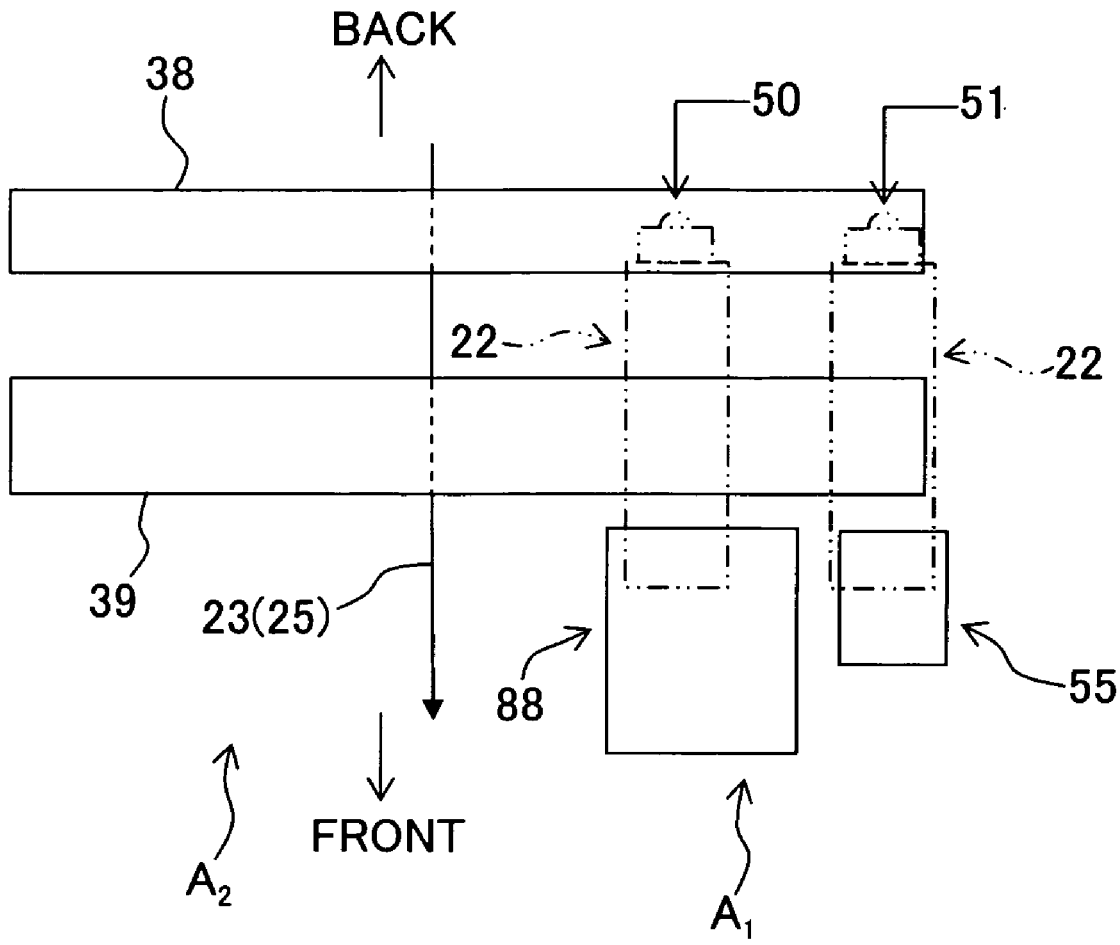
FIG. 11 schematically shows a different arrangement form of the ink supplement position and the purge position.

FIG. 11 schematically shows a different arrangement form of the ink supplement position 50 and the purge position 51. In the case of the arrangement shown in FIG. 11, the ink supplement position 50 and the purge position 51 are arranged adjacently in one area $A_1$ included in the two areas $A_1$, $A_2$ comparted by the recording paper transport path 23 (mainly by the straight path 25). Owing to the arrangement as described above, the movement distance of the carriage 19 is decreased between the ink supplement process (Steps S13, S18 shown in FIG. 10) and the purge process (Step S17 shown in FIG. 10) which are continuously executed during the maintenance. It is possible to shorten the movement time.

In the case of the arrangement shown in FIG. 11, the ink supplement position 50 is arranged nearer to the recording paper transport path 23 than the purge position 51. Owing to the arrangement as described above, the carriage 19 can be moved earlier from the recording paper transport path 23 to the ink supplement position 50 during the image formation. The ink supplement process, which has a higher execution frequency during the image formation, can be completed earlier.

In the foregoing explanation, the exemplary embodiments have been described, in which the present invention is applied to the liquid discharge apparatus for discharging the ink provided for the recording apparatus. However, the liquid to be discharged is not limited to the ink. The present invention is also applicable, for example, to any recording apparatus provided with any liquid discharge apparatus for discharging any liquid other than the ink including, for example, those for the reagent, the biological solution, the wiring material solution, the electronic material solution, the refrigerant, and the fuel.

What is claimed is:

1. A liquid discharge apparatus, comprising:

a discharge head which has a discharge port and discharges a liquid from the discharge port onto a recording medium to form an image thereon;

a sub tank which is movable together with the discharge head and which stores the liquid to be supplied to the discharge head;

a liquid supplement section which supplements the sub tank with the liquid;

a purge section which performs a purge operation in which the liquid in the sub tank is pressurized to be fed to the discharge head, and the liquid in the discharge head is forcibly discharged from the discharge ports;

a judging mechanism which judges whether or not an amount of the liquid in the sub tank is not more than a predetermined amount $V_1$; and a controller which controls the liquid supplement section and the purge section;

wherein: when the purge operation is executed by the purge section, and when the judging mechanism judges that the amount of the liquid in the sub tank is not more than the predetermined amount $V_1$, the controller controls, before the execution of the purge operation, the liquid supplement section to supplement the sub tank with the liquid until the amount of the liquid contained in the sub tank exceeds the predetermined amount $V_1$;

wherein the purge section includes a charge tank which accumulates compressed air to be introduced into the sub tank, and an unoccupied volume $V_S$ of the sub tank, which is a volume of the sub tank, not occupied by the liquid after the sub tank is supplemented with the liquid from the liquid supplement section, satisfies the following expression:

$$V_S \leqq \{(P_C - P_{S0})/(P_{S0} - P_0)\} \times V_C; \text{ and}$$

wherein $P_C$ represents a charge pressure of gas in the charge tank, $P_{S0}$ represents a minimum pressure required to purge the sub tank $P_0$ represents atmospheric pressure, and $V_C$ represents a volume of the charge tank.

2. The liquid discharge apparatus according to claim 1;

wherein the predetermined amount $V_1$ and the unoccupied volume $V_S$ satisfy the following expression:

$$V_1 = V_2 - V_S; \text{ and}$$

wherein $V_2$ represents an entire volume of the sub tank.

3. The liquid discharge apparatus according to claim 1;

wherein the unoccupied volume $V_S$ of the sub tank, after the sub tank is supplemented with the liquid, is a predetermined value greater than zero.

4. The liquid discharge apparatus according to claim 1;

wherein the controller controls the liquid supplement section so that a liquid-supplement velocity, which is adopted when the sub tank is supplemented with the liquid before the purge operation is executed, is greater than another liquid-supplement velocity which is adopted when the sub tank is supplemented with the liquid to form the image on the recording medium.

5. The liquid discharge apparatus according to claim 1;

wherein the liquid-supplement velocity, which is adopted when the sub tank is supplemented with the liquid to form the image on the recording medium, is a velocity at which a meniscus formed at the discharge port of the discharge head is not destroyed, and the another liquid-supplement velocity; which is adopted when the sub tank is supplemented with the liquid before the purge operation, is a velocity at which the meniscus is destroyed.

6. The liquid discharge apparatus according to claim 1;

wherein the controller controls the liquid supplement section to supplement the sub tank with the liquid again after the purge operation has been performed by the purge section.

7. The liquid discharge apparatus according to claim 1;

wherein the liquid supplement section and the purge section are arranged with a transport path for the recording medium intervening therebetween.

8. The liquid discharge apparatus according to claim 1;

wherein the liquid supplement section and the purge section are arranged adjacently in one area of two areas comparted by a transport path for the recording medium.

9. The liquid discharge apparatus according to claim 8;

wherein the liquid supplement section is arranged closer to the transport path than the purge section.

10. The liquid discharge apparatus according to claim 1;

wherein the liquid supplement section has a main tank which stores the liquid to be supplemented to the sub tank, and the controller controls the liquid supplement section to communicate the main tank and the sub tank, and to recover the liquid, remaining in the sub tank to the main tank, and to perform a liquid supplement operation in which the sub tank is supplemented with the liquid from the main tank.

11. The liquid discharge apparatus according to claim 10;

wherein the liquid supplement section has a pump which is capable of executing a sucking operation for recovering the liquid in the sub tank to the main tank, and a pressurizing operation for supplying the liquid in the main tank to the sub tank.

12. The liquid discharge apparatus according to claim 10;

wherein when the purge operation is executed by the purge section, and only when the liquid is discharged from the discharge head after previous supplement for the sub tank with the liquid, the controller controls the liquid supplement section to execute the liquid supplement operation.

13. A maintenance method for a liquid discharge apparatus provided with a discharge head which has a discharge port and which discharges a liquid from the discharge port onto a recording medium to form an image thereon, a sub tank which is movable together with the discharge head and which stores the liquid to be supplied to the discharge head, a main tank which supplements the sub tank with the liquid, and a purge section which performs a purge operation in which the liquid in the sub tank is pressurized to be fed to the discharge head, and the liquid in the discharge head is forcibly discharged from the discharge ports, the maintenance method comprising:

detecting a timing for maintenance;

detecting a liquid-residual amount of the liquid remained in the sub tank;

supplementing the liquid from the main tank to the sub tank until the liquid-residual amount of the liquid remaining in the sub tank is greater than a threshold value $V_1$ when the liquid-residual amount is not more than the predetermined threshold value $V_1$; and performing the purge operation by the purge section;

wherein the purge section includes a charge tank which accumulates compressed air to be introduced into the sub tank, and the liquid is supplemented so that an unoccupied volume $V_S$, of the sub tank, which is not occupied by the liquid after the sub tank is supplemented with the liquid from the main tank, satisfies the following expression:

$$V_S \leqq \{(P_C - P_{S0})/(P_{S0} - P_0)\} \times V_C; \text{ and}$$

wherein $P_C$ represents a charge pressure of gas in the charge tank, $P_{S0}$ represents a minimum pressure required to purge the sub tank, $P_0$ represents atmospheric pressure, and $V_C$ a volume of the charge tank.

14. The maintenance method for the liquid discharge apparatus according to claim 13;

wherein the threshold value $V_1$ and the unoccupied volume $V_S$ satisfy the following expression:

$$V_1=V_2-V_S; \text{ and}$$

wherein $V_2$ represents a volume of the sub tank.

15. The maintenance method for the liquid discharge apparatus according to claim 13;

wherein when the liquid-residual amount in the sub tank is not more than the predetermined threshold value $V_1$ then the liquid in the sub tank is recovered to the main tank, and the liquid is supplemented thereafter from the main tank to the sub tank until the liquid-residual amount in the sub tank is greater than the threshold value $V_1$.

16. The maintenance method for the liquid discharge apparatus according to claim 13;

wherein when the liquid-residual amount in the sub tank is more than the predetermined threshold value $V_1$, the purge operation is performed by the purge section without supplementing the sub tank with the liquid.

17. The maintenance method for the liquid discharge apparatus according to claim 13, further comprising;

supplementing the liquid again from the main tank to the sub tank after the purge operation.

* * * * *